US005116306A

United States Patent [19]

Zander

[11] Patent Number: 5,116,306

[45] Date of Patent: May 26, 1992

[54] ADJUSTABLE CLAVICLE STRAP AND ORTHOTIC DEVICE USING SAME

[75] Inventor: Linda K. Zander, Grass Lake, Mich.

[73] Assignee: Camp International, Inc., Jackson, Mich.

[21] Appl. No.: 578,560

[22] Filed: Sep. 6, 1990

[51] Int. Cl.[5] ..... A61F 5/02; A41F 9/00; A45F 3/02

[52] U.S. Cl. ..... 602/19; 128/DIG. 19; 224/202; 224/209; 2/312; 2/338

[58] Field of Search ..... 128/78, 87 R, 869, 870, 128/874-876, DIG. 19; 272/119; 2/44, 45, 311, 312, 338; 224/153, 202, 204, 208, 209, 215, 216

[56] References Cited

U.S. PATENT DOCUMENTS

| | | | |
|---|---|---|---|
| 3,888,245 | 6/1975 | Berntson et al. | 128/78 |
| 4,332,379 | 6/1982 | Bannister | 272/119 |
| 4,394,012 | 7/1983 | Egbert et al. | 272/119 |
| 4,570,619 | 2/1986 | Gamm | 128/78 |
| 4,674,664 | 6/1987 | Simon | 224/215 |
| 4,903,874 | 2/1990 | Shoemaker | 224/209 X |
| 4,936,495 | 6/1990 | Van de Pol | 224/209 |
| 4,948,122 | 8/1990 | Andrews, Sr. | 272/119 |

FOREIGN PATENT DOCUMENTS

| | | | |
|---|---|---|---|
| 809724 | 5/1951 | Fed. Rep. of Germany | 2/338 |
| 218063 | 7/1967 | Sweden | 272/119 |
| 2225926 | 6/1990 | United Kingdom | 128/78 |

*Primary Examiner*—Richard J. Apley
*Assistant Examiner*—Linda C. M. Dvorak
*Attorney, Agent, or Firm*—Price, Heneveld, Cooper, DeWitt & Litton

[57] ABSTRACT

An adjustable clavicle strap is disclosed, joined to a posture training device. The strap has two portions which extend from an object which is to be fastened to the user. Each portion has an end away from the object and a tether is connected between each such end to keep the ends in the general proximity of each other.

8 Claims, 1 Drawing Sheet

ADJUSTABLE CLAVICLE STRAP AND ORTHOTIC DEVICE USING SAME

CROSS REFERENCE TO RELATED APPLICATION

One aspect of this invention is an improvement on the invention claimed in U.S. patent application Ser. No. 07/579,349, entitled "POSTURE TRAINING SUPPORT" filed on even date herewith.

BACKGROUND OF THE INVENTION

The present invention relates to adjustable clavicle straps. Numerous situations exist wherein one might use an adjustable clavicle strap to secure an object or device to one's body. Such situations include the use on women's brassieres, use on a wide variety of commonly known backpacks and use on various medical prosthetic or orthotic devices The present invention also relates to a unique posture training support incorporating such straps.

The commonly known clavicle strap is found in a one-piece arrangement wherein a strap of material has two ends and both ends are attached to an object which is to be positioned on one's back forming a loop extending from the object. The one-piece strap is used by simply inserting one's arm through the loop and sliding the loop up over one's shoulder to a position where the strap extends from the object positioned on one's back, over the clavicle, around the torso and back to the object. Such a clavicle strap does not offer adjustability to better fit the strap to the user and enhance comfort, although, such straps are sometimes made of elastic material in an attempt to make one size fit all. However, such elastic strapping typically compromises the utility of the strapping, and it is inevitable that the strap will lose its elasticity.

Another form of clavicle strap is the two-piece strap with a fastener. This is basically similar to the one-piece strap, above, but with a fastener fitted approximately midway in the loop of the strap so that the strap is actually two pieces connected at the fastener. Such two-piece straps can be more convenient and more comfortable than the one-piece strap, since they typically include an adjusting feature and it is sometimes more convenient to place the object upon one's back prior to positioning the clavicle strap over the clavicle and around the torso. The fastening means often includes a buckle device, which can be a clasp positioned on one portion of the strap and a cooperating latch plate positioned on the other portion of the strap or might be a buckle structure positioned on one portion of the strap through which the end of the other portion of the strap is laced and secured. Other fastening means include the commonly known hook and loop fastening fabrics and snap fasteners.

While the two-piece clavicle strap with fastener does present advantages over the one-piece strap, it can still be inconvenient to use. Having positioned an object to be strapped to one's back and placed the upper portion of the two-piece clavicle strap over the clavicle, one is left to blindly search behind one's self for the companion piece of the strap which is to be brought around the torso and mated with the upper portion of the strap. Oftentimes, this can lead one to simply keep the two portions of the strap fastened together at all times, partially defeating some advantage of the two-piece strap.

These problems can be especially aggravating in connection with orthotic devices. Such devices are often used by people whose physical problems make it more difficult to manipulate the straps associated with orthotic devices. Shoulder orthoses, used for posture training (including posture control) typically combine a thoracic band, a brace and shoulder straps.

SUMMARY OF THE INVENTION

The adjustable strap system of the present invention addresses the failures of the prior straps with a tether which is connected near each end of the two portions of a two-piece strap and which extends between those two portions to keep the two ends in general proximity of each other. Thus, the user will readily find the two cooperating ends and will not need to search for them.

In one aspect of the invention, the tether is made from an elastic material, minimizing the required length of the tether and minimizing any restriction in putting on and removing the clavicle strap. In another aspect of the invention a posture training support includes a small, compact pocket for holding weights, which is strapped on the user's back by the straps of the present invention.

These and other objects, advantages and features of the present invention will become apparent upon review of the following specification in conjunction with the drawings.

DESCRIPTION OF THE PREFERRED EMBODIMENT

Figure 1:
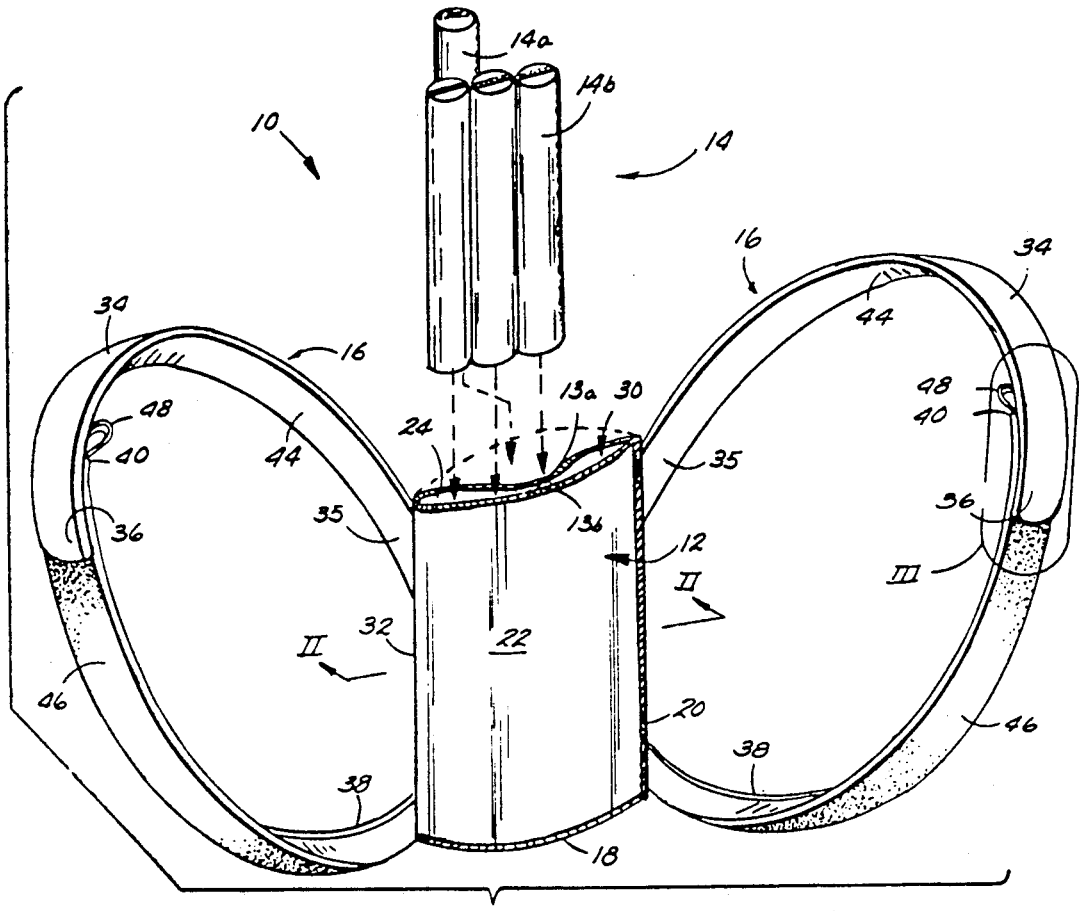
FIG. 1 is a frontal perspective view of the present invention as used with a carry pouch.

In the preferred embodiment, adjustable clavicle strap 16 includes an upper portion 34 and a lower portion 38 (FIG. 1). They are shown in the preferred embodiment secured to a small pouch 12 into which weights 14 can be placed to assist in posture training.

Upper portion 34 has a first end 35 attached to pouch 12, for example, which is to be fastened to the user's back (FIG. 1). Upper portion 34 also has a second end 36, away from pouch 12. Upper portion 34 is preferably provided with a patch 42 of the hook portion of a hook-and-loop fastening fabric, near end 36 and on inner surface 44 (FIG. 3).

Lower portion 38 has a first end 39, also attached to pouch 12, and a second end 40, away from pouch 12 (FIG. 1). Lower portion 38 has an outer surface 46 which is covered at least near end 40 with a loop pile for releasable fastening engagement with hook patch 42 (FIG. 3).

Figure 3:
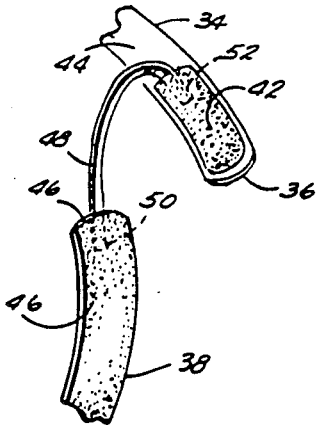
FIG. 3 is a detailed view of the strap adjustment means as indicated by detail III in FIG. 1.

Tether 48 is made of an elastic strip material and is connected between upper portion 34 and lower portion 38 near ends 36 and 40, respectively (FIG. 3). Tether 48 is fastened at one end 50 to lower portion 38 at end 40. Tether 48 is fastened at its other end 52 to upper portion 34 near the edge of hook patch 42 away from end 36. In the preferred embodiment, tether 48 is approximately 4 inches long and stretches to approximately 9 inches.

Pouch 12 is preferably made of a single piece of soft, durable material, such as a relatively thick, spongy material, with a loop pile surface to give a soft feel. The material is folded over itself and sewn along two sides 18 and 20 to form the rectangular pouch 12 with open top 30 (FIG. 1).

Figure 2:
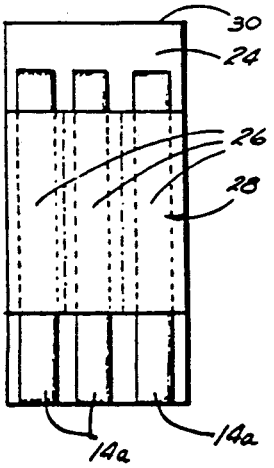
FIG. 2 is a sectional view of the pouch as indicated by section line II—II in FIG. 1.

Pouch 12 has a front portion 22 which lays against the back of a patient in use and a back portion 24 which faces away from the patient in use. Weight pockets 26 are provided on the inside surface of back portion 24 for holding individual weights 14*a* (FIG. 2). Weight pockets 26 are formed by sewing a band of elastic material 28 to the inside surface of back portion 24 so that equal loops are formed in the elastic material 28 to define the weight pockets 26.

Pouch 12 is small and thin so as to be unobtrusive when worn. Its length and width define an area which is preferably significantly smaller than the area of a median adult back, indeed preferably less than one-half such back area and most preferably less than one-quarter such back area. On a larger back, pouch 12 nestles into the space between the lower portions of the shoulder blades. Pouch 12 is from about 4 to 8 inches long, about 2 to 4 inches wide, and no thicker than about 0.5 inch when empty and about 1.5 inches when filled with weights 14. A most preferred length is about 7 inches and a most preferred width is about 3.5 inches. Pouch 12 preferably has some thickness when empty in that pouch 12 is preferably made of a soft cushiony material for comfort.

Pouch 12 includes a hook 13*a* and loop 13*b* closure system at open top 30 so that weights 14 which are placed in pouch 12 do not bounce out or otherwise work their way out of pouch 12 when walking vigorously or running.

Individual weights 14*a* are secured in pockets 26 (FIG. 2). The large, multiple weight 14*b* does not need to be secured in pockets 26. When weight 14*b* is used, it is simply placed inside pouch 12 (FIG. 1). Each weight 14 is preferably a relatively soft, pliable weight, such as can be made by filling a fabric pocket with metallic pellets, so that the weights 14 will conform to the surface of the patient's back to enhance comfort. Further, when individual weights 14*a* are used in combination with the multiple weight 14*b*, the multiple weight 14*b* is preferably positioned near the patient's back and the individual weights 14*a* positioned away from the patient's back for enhanced comfort.

Each individual weight 14*a* weighs approximately 4 ounces. Multiple weight 14*b* preferably weighs about 16 ounces. Thus, the weight is adjustable in 0.25 pound increments to a total of about 1.75. Obviously, some variation in these weights is permissible within the broader aspects of the invention. You could, for example, simply use two 1-pound weights in pouch 12.

The pouch 12 is properly positioned below the inferior angle of the scapulae on the back of the patient. Such proper positioning is accommodated in a range of patient sizes by the adjustability of straps 16. The use of hook patch 42 and the loop pile material on the outer surface 46 of each lower portion 38 provides a comfortable adjustment range for each strap of approximately 6 inches. Further, a range of sizes of straps is provided, such as double extra small, with lengths of approximately 9.75 inches and 13.75 inches for the upper and lower portions 34 and 38, respectively, through extra large, with lengths of approximately 13.75 inches and 17.75 inches for the upper and lower portions 34 and 38, respectively. Thus, support 10 can be used for a large range of patient sizes with some variation permissible within the broader aspects of the invention.

In use, a combination of weights 14 is selected by the treating physician for the appropriate amount of weight to treat a specific patient. Individual weights 14*a* are secured in weight pockets 26 of pouch 12 (FIG. 2). A multiple weight 14*b* is simply placed inside pouch 12 and does not need to be secured in weight pockets 26 (FIG. 1).

The patient wears support 10, under his or her clothing, by inserting his or her arms through clavicle straps 16 with ends 36 and 40 separated. Elastic tethers 48 keep ends 36 and 40 in proximity to each other and thereby make it easier to fasten ends 36 and 40 of straps 16, once straps 16 are in place over the patients arms. The fact that tethers 48 are elastic, makes it easier for the patient to position and fasten the straps 16. Pouch 12, containing weights 14, is positioned below the inferior angle of the patient's scapulae and the clavicle straps 16 are adjusted for the patient's comfort to secure pouch 12 in the proper position. This adjustment is easily accomplished by varying the point at which hook patch 42 is lapped over the loop pile of surface 46.

The above description is considered that of the preferred embodiment only. Modifications of the invention will occur to those who make or use the invention. Therefore, it is understood that the embodiments shown in the drawings and described above is merely for illustrative purposes and is not intended to limit the scope of the invention, which is defined by the following claims as interpreted according to the principles of patent law The embodiments of the invention in which an exclusive property or privilege is claimed are defined as follows:

1. A clavicle strap assembly comprising:

a two-piece clavicle strap for securing an object to a user's back, each of said two pieces having a first end fastened to said object and a second end for releasably fastening to the second end of the other piece, one of said two pieces being an upper portion, said upper portion extending from said first end, over the clavicle of the user, to said second end, and the other of said two pieces being a lower portion, said lower portion extending from said first end, around the torso of the user, to said second end;

fastening means for fastening said two pieces together at said second ends; and a tether connected between said two pieces, near said second ends.

2. The assembly defined in claim 1 wherein one of said two pieces has an inner surface, said surface having a patch of the hook portion of a hook and loop fastening fabric near said second end, and the other of said two pieces has an outer surface, said surface having a loop pile at least near said second end for releasable fastening engagement with said patch.

3. The assembly defined in claim 1 wherein said tether comprises a strip of elastic material.

4. A posture training support comprising:

a pouch for holding weight on the back of a patient, said pouch having length, width and thickness, said length and width defining an area which is significantly smaller than the area of the back of a median adult patient, said thickness being sufficiently thin that said pouch can be unobtrusively worn under the patient's clothing;

at least one weight located in said pouch; and clavicle straps secured to said pouch for strapping said pouch onto a patient's back, each of said clavicle straps comprising:

a two-piece strap, each of said two pieces having a first end secured to said pouch and a second end for releasably fastening to the second end of the other piece;

fastening means for fastening said two pieces together at said second ends; and a tether connected between said two pieces, near said second ends.

5. The support defined in claim 4 wherein said tether comprises a strip of elastic material

6. The support defined in claim 5 wherein said pouch includes an open top whereby said weight can be removed from said pouch.

7. The support defined in claim 6 wherein said straps are sized to position said pouch below the inferior angle of the patient's scapulae.

8. The support defined in claim 7 wherein said straps include a hook and loop fastening fabric for adjusting said straps.

* * * * *